United States Patent [19]

Bucefari et al.

[11] Patent Number: 4,999,989

[45] Date of Patent: Mar. 19, 1991

[54] MACHINE FOR THE PRODUCTION OF AN ORNAMENTAL CHAIN OF THE TYPE FORMED BY "FIGURE-OF EIGHT" LINKS

[75] Inventors: Massimo Bucefari; Corrado Lapini; Michele Lazzarini, all of Arezzo, Italy

[73] Assignee: C.M.S. S.P.A. Costruzione Macchine Speciali, Arezzo, Italy

[21] Appl. No.: 405,176

[22] Filed: Sep. 11, 1989

[30] Foreign Application Priority Data

Sep. 13, 1988 [IT] Italy ..... 9483 A/88

[51] Int. Cl.[5] ..... B21L 3/00

[52] U.S. Cl. ..... 59/18; 59/23; 59/27

[58] Field of Search ..... 59/18, 22, 20, 16, 1, 59/35.1, 80

[56] References Cited

U.S. PATENT DOCUMENTS

| | | | |
|---|---|---|---|
| 4,275,555 | 6/1981 | Bichi | 59/18 |
| 4,311,003 | 1/1982 | Tega | 59/16 |
| 4,503,664 | 3/1985 | Allazzetta et al. | 59/16 |
| 4,548,031 | 10/1985 | Massimo et al. | 59/16 |
| 4,644,743 | 2/1987 | Bucefari et al. | 59/16 |
| 4,872,305 | 10/1989 | Lapini et al. | 59/16 |

*Primary Examiner*—David Jones

*Attorney, Agent, or Firm*—Browdy and Neimark

[57] ABSTRACT

A machine for the production of an ornamental chain of the type formed by so-called "figure-of-eight" links, comprising a slide (23) for transferring a section of wire of prefixed length, folded in a U shape, from a unit (51) for supplying said section of wire to a calibrated tubular guide (34), holding the already formed chain, to engage it with the last formed link of the chain. The guide (34) is radially surrounded by tools for bringing together (55,56) and permanently joining (71,72) the ends of the arms of said U-shaped section engaged in the last U-shaped link, and tools for centring (73) the resulting closed link with respect to the axis of the guide (34).

A push device (81) is further provided for performing an alternating movement away from and towards the last formed U-shaped link along the axis of the guide (34) so as to supply a force onto said link, causing at the same time sliding of the chain inside the guide and folding the closed link about its middle transverse axis.

14 Claims, 7 Drawing Sheets

109
100
104b
105
103
104a
84
77
82
85
83
81
S2
XII
102
104
108
15
6
23
25
29
65
101
107
67
12
P
2
38
8
24
10
11
25
4
106
39
5a
7
68
3
8
19
46
26
32
3
69

MACHINE FOR THE PRODUCTION OF AN ORNAMENTAL CHAIN OF THE TYPE FORMED BY "FIGURE-OF EIGHT" LINKS

FIELD OF THE INVENTION

The present invention relates to a machine for the production of an ornamental chain of the type formed by so-called "figure-of-eight" links' in the goldsmith's and trinkets sector.

STATE OF THE ART

It is known that the ornamental chain of the aforementioned type, a section of which is illustrated in FIG. 1, consists of a succession of links of elongate shape folded in a U shape about their middle transverse axis and twisted about the axis of the chain. At the present time, such a chain is produced using manual methods. In practice, sections of wire made of precious or non-precious material are prepared and folded in U shape, and the semi-finished product thus obtained is threaded with its free arms inside the end eyelets resulting from folding into a U shape and subsequent axial twisting of a link previously attached. The U-shaped semi-finished product is then closed and welded, producing a flat link of elongate shape which is folded in a U shape about its middle transverse axis and then subjected to twisting about the axis of the chain. As can be clearly understood, the manual production of a similar type chain is fairly laborious and requires the use of a particularly skilled labour force.

The object of the present invention is to provide a machine which allows the completely automated production of the aforementioned ornamental chain.

According to one of the characteristic features of the machine forming the subject of the present invention, the chain being formed passes inside a tubular guide, or die, of calibrated cross-section, substantially the same as that of the chain itself so as to offer a certain resistance to sliding, obtained only by means of forcing, in the direction of the axis of the chain. This forcing action causes on each occasion sliding of a chain section corresponding to one link, leaving the eyelet ends of the last attached link projecting from said guide so as to allow insertion of a section of wire folded in a U shape inside them. The ends of the U-shaped section are then brought together and permanently joined so as to form a closed link and it is the same axial forcing action imparted so as to cause sliding of the chain in the die, which also produces folding of the aforementioned closed link into a U shape.

According to another characteristic feature of the machine forming the subject of the present invention, there is provided an element capable of sliding alternately in a direction perpendicular to the axis of the die, which removes the U-shaped section of wire from a unit which is intended for forming thereof or distribution thereof and conveys it towards the die, engaging the arms of said shaped section inside the eyelet ends of the link previously applied to the chain and folded in a U shape.

According to a further characteristic feature of the machine forming the subject of the present invention, the formation of the closed link from the U-shaped section of wire after its engagement inside the last link of the chain is obtained by means of the simultaneous action of folding, gripping and centering tools cooperating with a conventional welding device and with the tool which causes folding into a U shape of the closed link. In this way, as a result of the gripping tools which act on the sides of the link after the free ends thereof have been brought together, it is possible to perform correctly welding of the two ends brought together. Similarly, as a result of the centering tools, acting on the opposite ends of the link, it is possible to fold the closed link exactly about its middle transverse axis.

According to a further characteristic feature of the machine forming the subject of the invention, the said machine comprises a group for the production of sections of metal wire of predetermined length cooperating with means for shaping this section into a U, integral with the abovementioned sliding element.

The object of the present invention, therefore, is a machine for the production of an ornamental chain of the type formed by so-called "figure-of-eight" links, a chain consisting of a succession of elongated links folded in a U shape about their middle transverse axis and twisted about the axis of the chain, said machine being characterized in that it comprises: a working plane; means for supplying a section of filiform material of predetermined length folded in a U shape, coplanar with said working plane and in a first working direction; a tubular guide with a calibrated cross-section and with an axis perpendicular to said working plane, designed to support internally the chain already formed and having an upper edge from which the eyelet ends of the last U-shaped link attached project, said first working direction intersecting the axis of said tubular guide at said ends, said tubular guide being designed to perform an angular displacement of predetermined amplitude and direction about its own axis in order to twist the last U-shaped link attached on each occasion; means for conveying said U-shaped towards said tubular guide performing an alternating translatory movement in said first working direction, designed to remove said U-shaped section from said supply means and to engage the arms thereof inside the projecting eyelet ends of the last U-shaped link attached; means for bringing together and permanently joining the ends of the arms of said U-shaped section engaged in the last U-shaped link attached, movable away from and towards said tubular guide along said working plane and means for centering the resulting closed link with respect to the axis of said guide; punch means performing an alternating movement away from and towards the last U-shaped link attached along the axis of said tubular guide in order to apply a force on said link causing at the same time sliding of the chain inside said guide and folding of said closed link about its middle transverse axis.

Further characteristic features and advantages of the machine for the production of ornamental chains of the type formed by "figure-of-eight" links will emerge more clearly from the description which follows of an embodiment thereof, provided by way of a non-limiting example with reference to the accompanying drawings in which.

Figure 1:
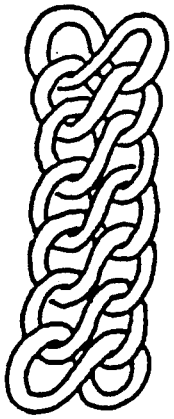
FIG. 1 illustrates a section of the chain produced using the machine according to the invention.
Figure 2:
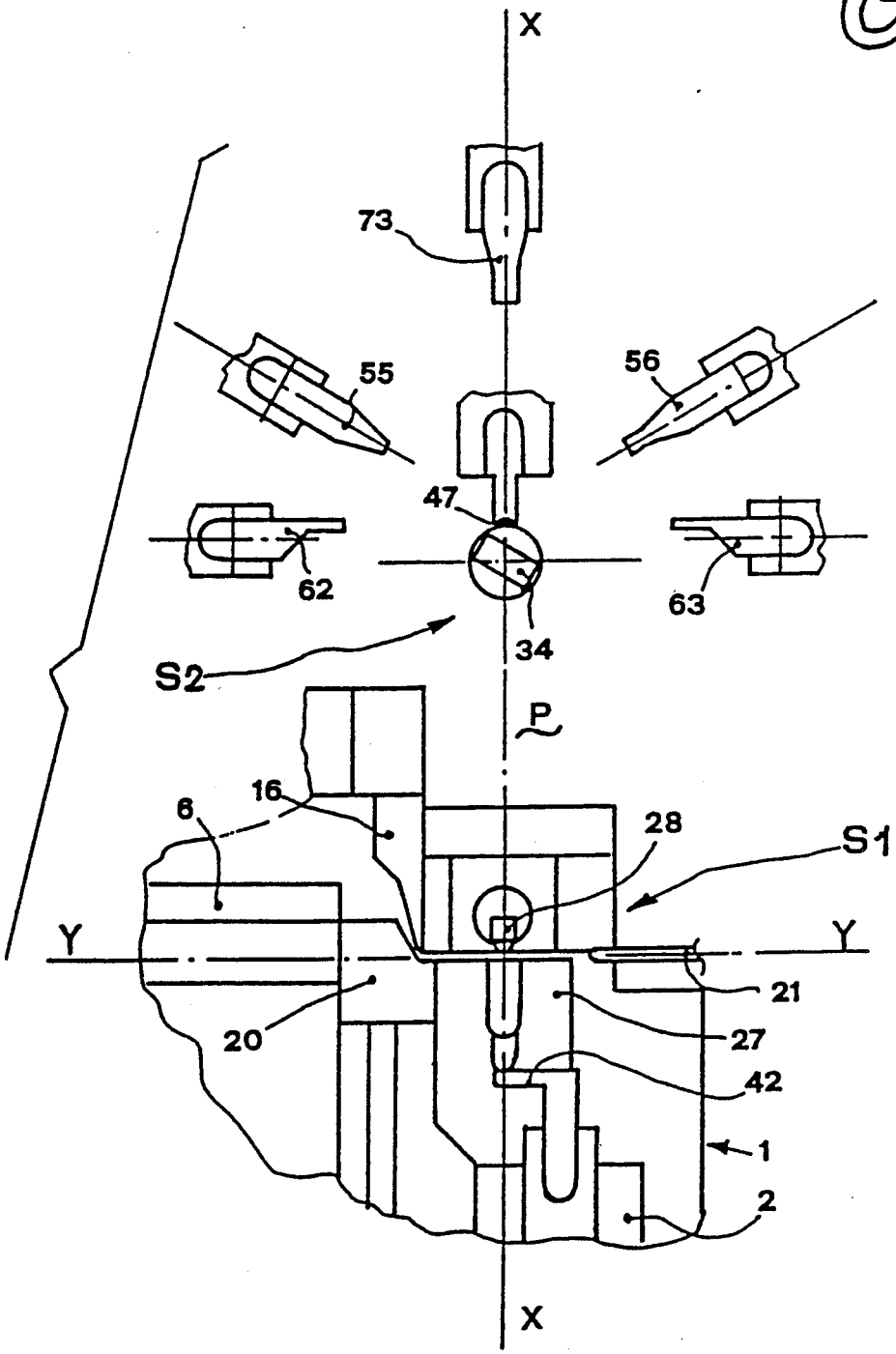
FIG. 2 is a schematic plan view of the machine according to the invention.

With reference to the aforesaid figures, and in particular FIG. 2 for an overall schematic view of the machine, the latter is made up substantially of two stations, indicated by S1 and S2, operating on a horizontal working plane P. The first of the stations is intended for the formation of semi-finished products consisting of sections of wire, made of precious or non-precious metallic material, of predetermined length and folded in a U shape, while the second station is intended for the preparation of the chain using the abovementioned semi-finished products, supplied to it one at a time, by means of successive operations consisting in: inserting each semi-finished product in the last link of the chain, forming a closed link from such a semi-finished product, folding the closed link into a U shape about its middle transverse axis and twisting about the axis of the chain. The U-shaped sections are supplied from the station S1 to the station S2 by conveying means, indicated generally by 1 in FIG. 2, which move to and fro between the two stations in a main working direction X—X.

Figure 3:
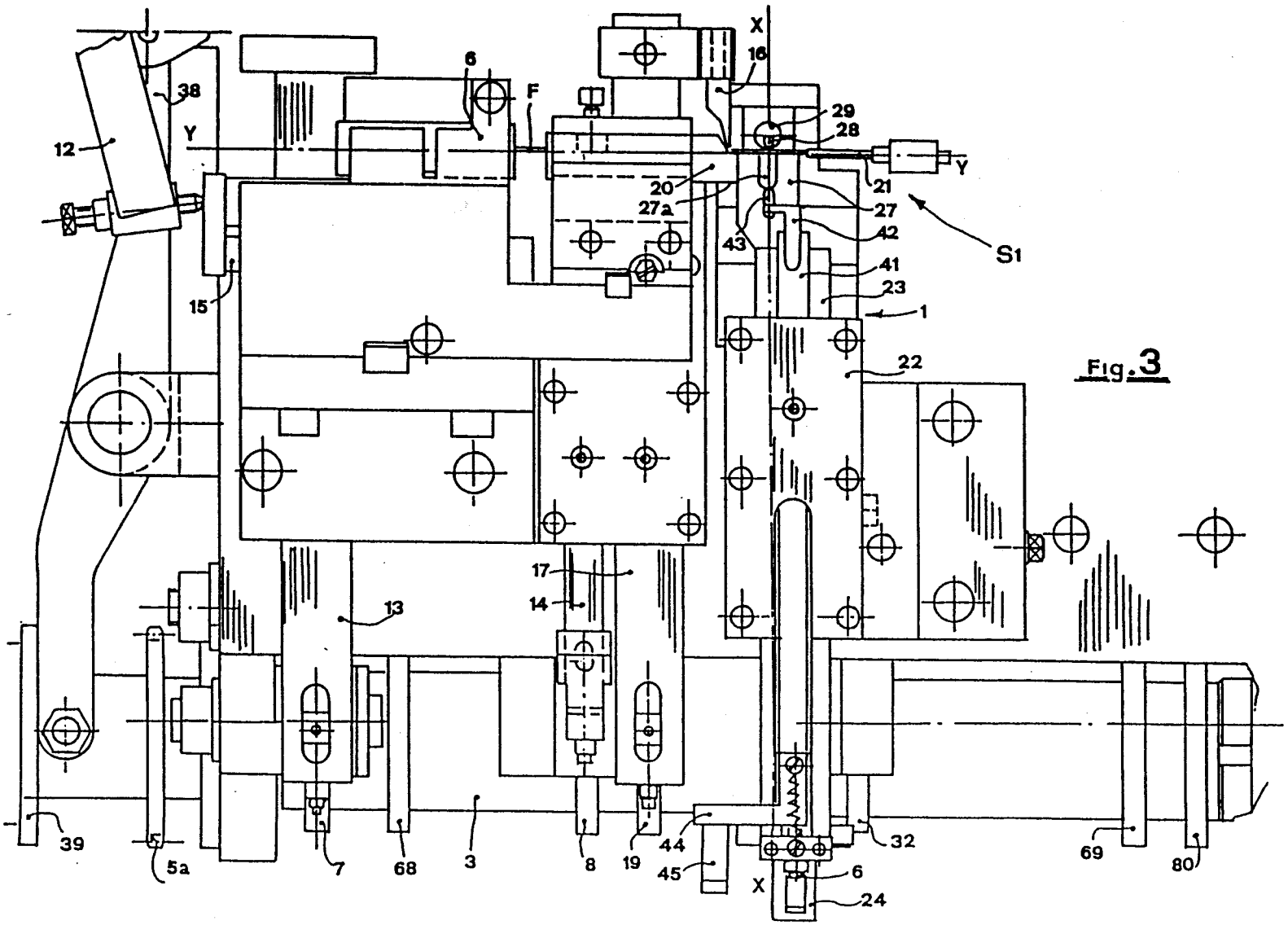
FIG. 3 is a plan view from above of the front part of the machine.
Figure 4:
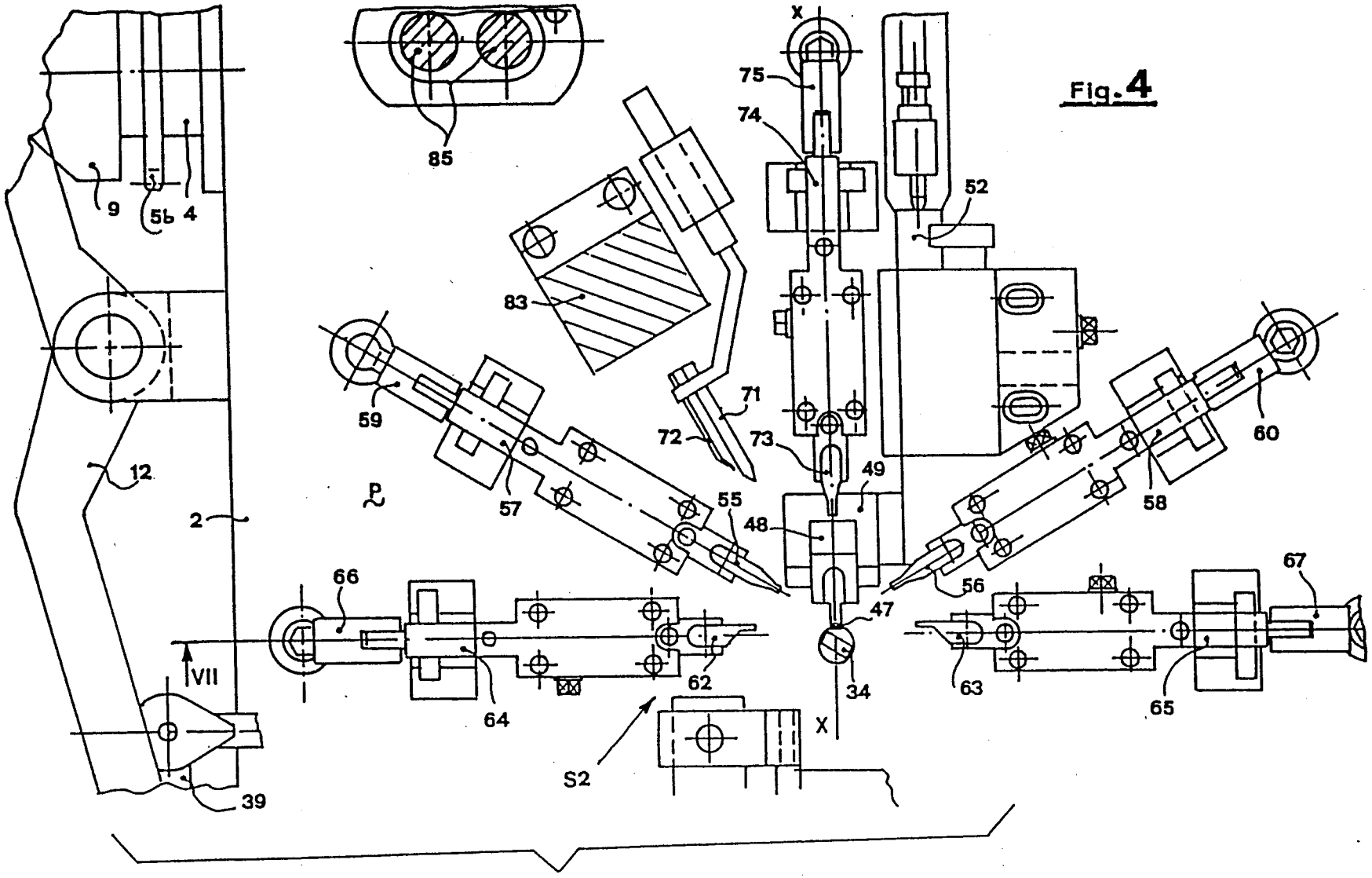
FIG. 4 is a plan view from above of the rear part of the machine.
Figures 5, 12:
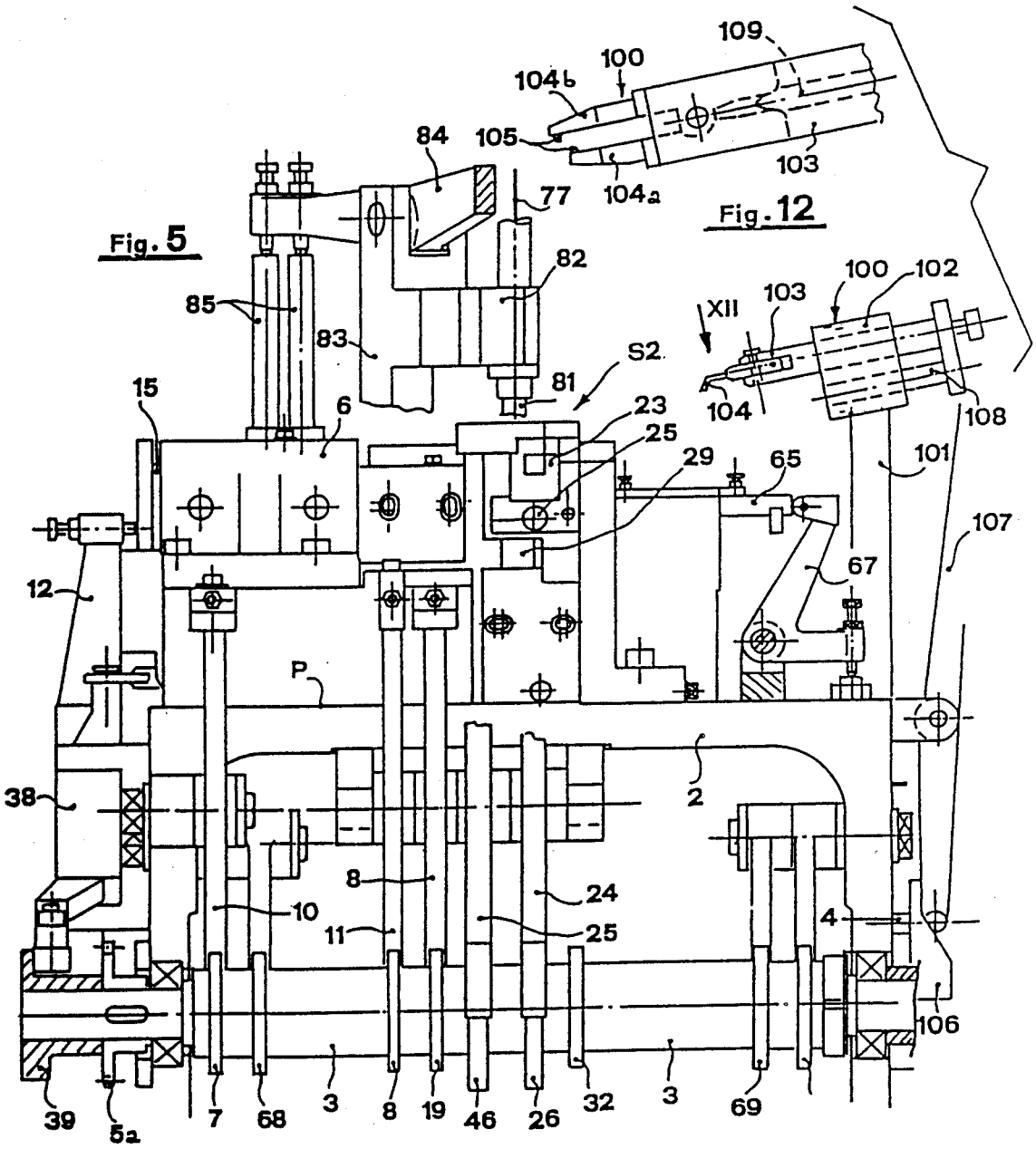
FIG. 5 is a front view of the front part of the machine.
FIG. 12 is a detailed view in the direction of the arrow XII of FIG. 5.

With reference also to FIGS. 3, 4 and 5, the working plane P, extending horizontally, extends above a bench 2 above which the two stations S1 and S2 are installed, respectively in the region of the front portion (i.e. closest to the operator) and rear portion of the bench itself. Beneath the working plane P, the bench 2 supports two cam shafts 3 and 4 for actuating the various components of the machine, mounted respectively underneath the station S1 and underneath the station S2. The two shafts 3 and 4 are connected together for the transmission of the movement (toothed wheels 5*a* and 5*b*) and to conventional motor-driven means not shown.

With reference to FIGS. 3 and 5, the station S1 comprises a conventional supply group 6, of the slide type, for the metal wire F. The movements of the supply group 6 are provided, in a known manner, by means of the cams 7 and 8 of the front shaft 3 and the cam 9 of the rear shaft 4 which actuate respectively levers 10, 11 and 12 connected respectively to the slide 13 (operation of rear wire-press), to the slide 14 (operation of front wire-press) and to the slide 15 (operation of slide for forward movement of the wire F). For the formation of sections of predetermined length there is provided a cutting group, also of the conventional type, at the outlet of the wire-supply group, formed by a cutter 16 acting perpendicularly to the direction in which the wire is supplied Y—Y, being integral with a slide 17 connected to a lever 18 actuated by the cam 19 of the front shaft 3. In the front position with respect to the outlet 20 of the supply group 6 and in the direction YY of forward movement of the wire F there is arranged a stop element 21 against which the wire stops an instant before being cut. The position of the stop element 21 is adjustable and is itself movable from an operating position to a rest position.

Figure 6:
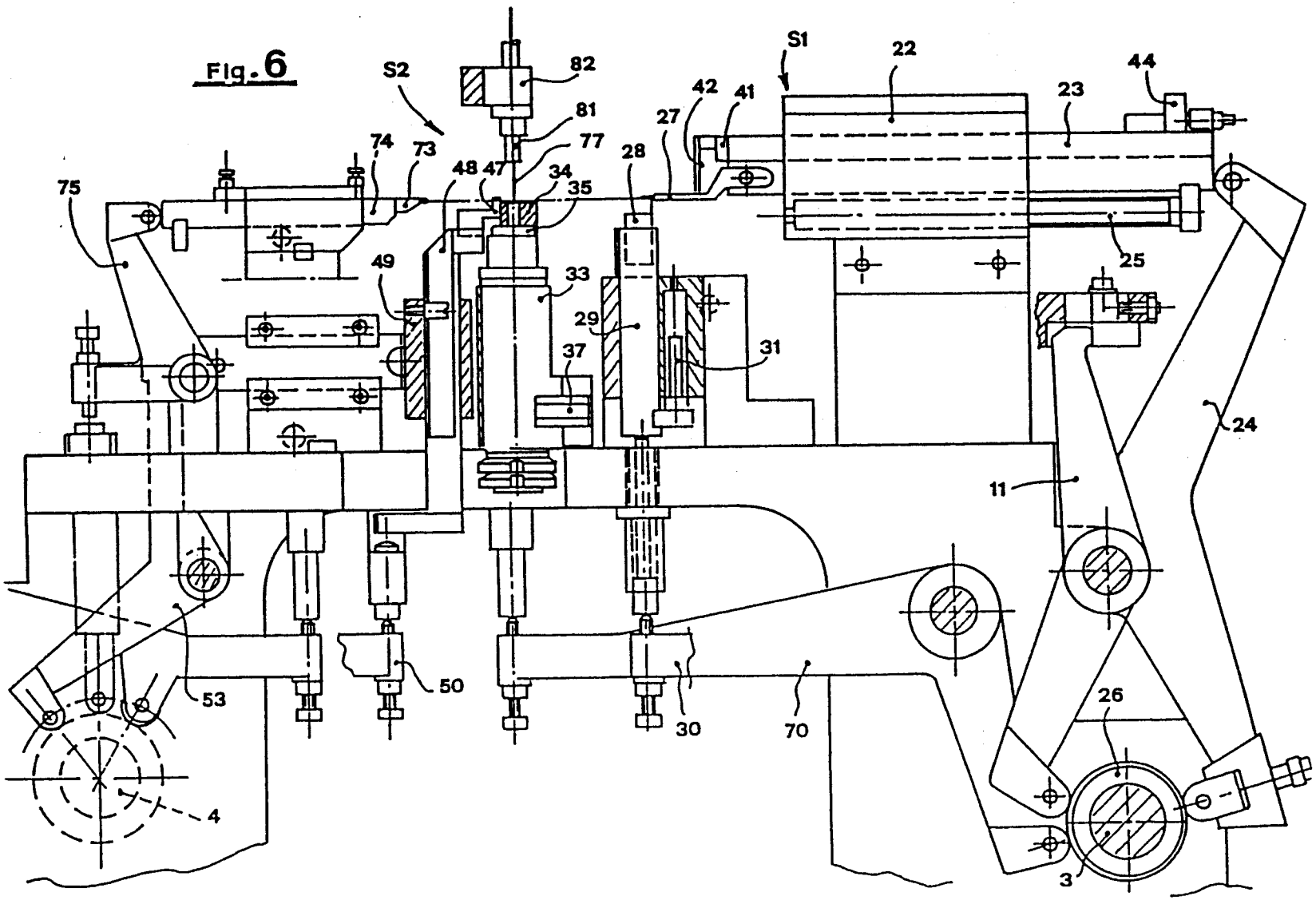
FIG. 6 is a side view of the machine, substantially along the working axis X—X of the same machine.

Alongside the supply group 6 and in the working direction X—X there is mounted on the bench 2 a block 22 acting as a guide for a slide 23 made to perform an alternating translatory movement in the direction X—X by a lever 24 (see also FIG. 6), operating in opposition to a return spring 25 and actuated by a cam 26 of the front shaft 3. At the end of the slide 23 there is mounted a fork-shaped forming element 27 defining a U-shaped cavity 27*a* which extends at the same height as the outlet mouth 20 for the wire F and hence coplanar with the latter. A continuous groove is formed on the internal wall of the U-shaped cavity 27*a*. Opposite the element 27, beyond the axis Y—Y, there is provided a vertical pin 28, perpendicular to the working axis X—X, mounted at the end of a support 29 performing a translatory alternating movement in the direction perpendicular to the plane P, owing to the action of the lever 30, operating in opposition to the spring 31 and actuated by the cam 32 of the front shaft 3 (FIG. 6). The pin 28 is therefore displaced from a working position where it interacts operationally with the element 27, to a lowered rest position. On the slide 23 there is also mounted a second slide 41 which carries at its end a shoe 42 which moves down inside a seat 43 formed on the bottom of the cavity 27*a*. The second slide 41 performs an intermittent alternating translatory movement along the slide 23, since a lever 45 actuated by the cam 46 of the front shaft 3 acts on a projecting shoulder 44 thereof. The movement of the second slide 41 with respect to the slide 23 occurs when the latter has reached the station S2, as will be seen below.

Figure 8:
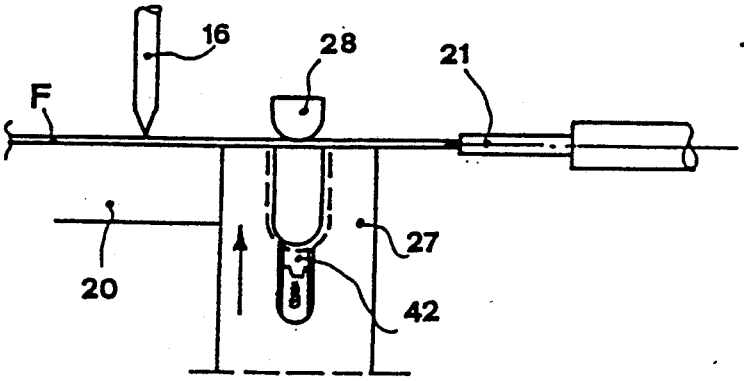
FIGS. 8, 9, 10 and 11 illustrate schematically the main operating phases of the machine according to the invention.

From the above it is clear that, once the cutter 16 has cut a section of wire of predetermined length, the slide 23 (see FIG. 8) moving forward in the direction XX towards the station S2 pushes the section itself against the pin 28 forcing it to fold inside the cavity 27*a* and to assume the U-shape, arranging itself inside the groove formed therein.

Figure 7:
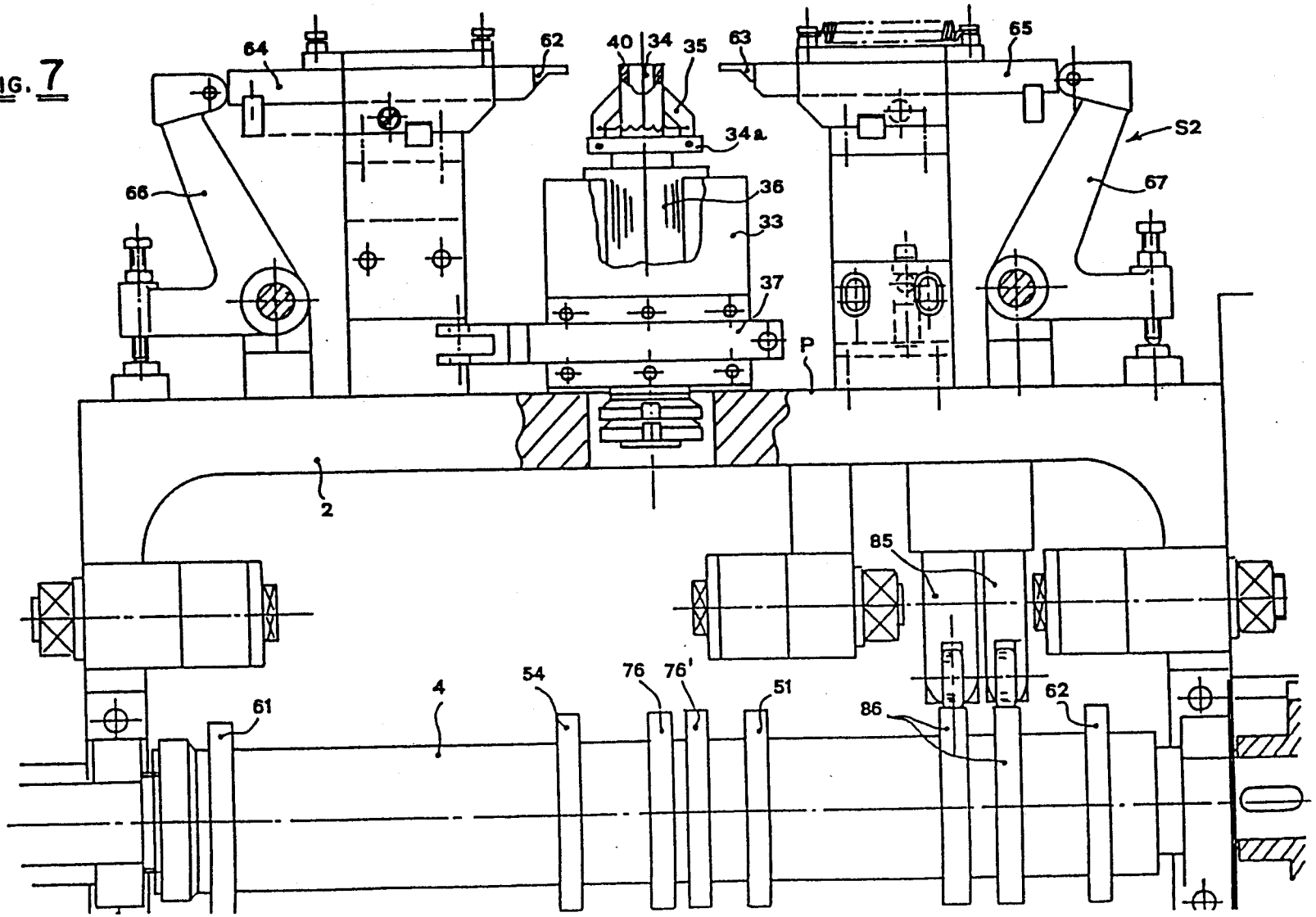
FIG. 7 is a rear view of the machine according to the invention in the direction of the arrows VII—VII of FIG. 4 with the die group partially sectioned.

With reference now to FIGS. 4 and 7, the station S2 for forming the chain with the sections folded in a U shape, prepared in the station S1, comprises a hollow support 33, rising from the bench 2 and coinciding the axis X—X, inside which there is mounted a shaft 36, at the top end of which there is fixed a tubular guide or die 34 with a calibrated cross-section substantially the same as that of the chain to be constructed.

Figure 11:
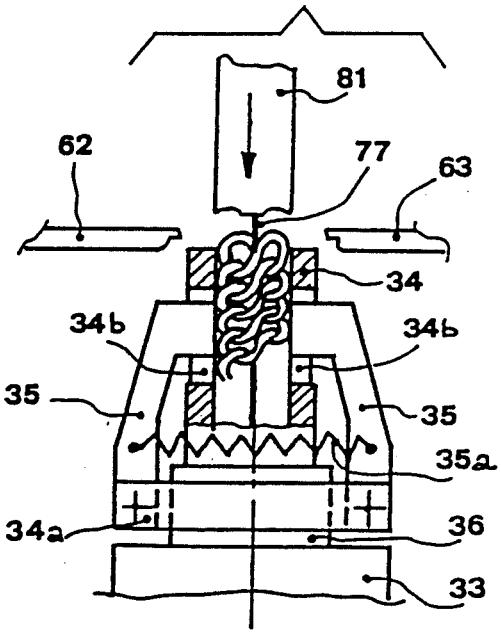

Coaxial with the die 34 there is fixed a ring 34*a* with which are hinged, on diametrically opposite sides, two arms 35 which with their two free ends engage inside slots 34*b* (FIG. 11) formed laterally on the die 34 emerging in the inner passage of the die 34 itself. The two arms are connected by a spring 35*a*, shown in FIG. 11, which tends to move the respective ends towards each other. On the lateral surface of the shaft 36 there is formed a toothed portion, not shown, inside which there engages a rack 37 performing an alternating translatory movement parallel to the plane P, since it is connected in a conventional manner, not shown, to a lever 38 actuated by the cam 39 of the front shaft 3 (visible in FIG. 3). The chain formed previously extends inside the hollow shaft 36 emerging from the bottom and is supported by the die 34 and by the arms 35 which tend to grip it elastically. The two eyelet ends of the last link of the chain project with respect to the edge 40 of the die 34 and in particular the chain is held inside the die 34 in a position such that one of the two eyelet ends is arranged on one side and the other on the other side with respect to the working axis X—X. For these purposes, the cross-section of the die 34 is substantially rectangular in accordance with the transverse dimensions of the chain, and the median axes of this cross-section are inclined at about 45° with respect to the axis X—X.

When the slide 23 reaches the station S2 bringing with it the U-shaped section into the appropriate groove of the cavity 27*a*, the second slide 41 starts to travel on the slide 23 in the direction X-X, as a result of which the shoe 42 pushes the section outside the cavity 27*a*, engaging it into the eyelet ends projecting from the die 34 and remaining then in opposition to said section.

With reference to FIGS. 4 and 6, behind the support 33 of the die 34 there is provided a vertical counter pin 47 arranged at the end of a support 48 mounted so as to slide inside a sleeve 49 owing to the action of a lever 50 operated by a cam 51 of the rear shaft 4. The sleeve 49 is in turn integral with a slide 52 actuated by a lever 53 operated by a cam 54 of the rear shaft 4. The counter pin 47 therefore performs a vertical alternating movement so as to move from a lowered position into a position situated at the same height as the edge 40 of the die 34, and a movement towards and away from the die block along the axis X—X.

As shown in FIG. 4, in a symmetrical position with respect to the axis X—X, there are arranged two folding tools 55 and 56 whose operating axes, lying on the plane P, converge towards the pin 47. The two tools 55 and 56 perform a simultaneous alternating translatory movement away from and towards the counter pin 47, being mounted at the ends of respective slides 57 and 58 actuated by the levers 59 and 60 operated by the cams 61 and 62 of the rear shaft 4.

Figure 9:
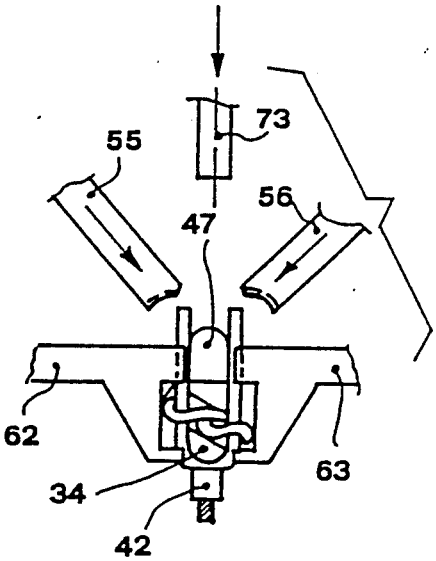
Figure 10:
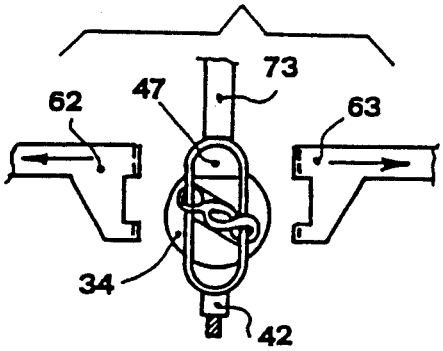

Alongside the die block in a symmetrical position with respect to the axis X—X there are also provided two gripping tools 62 and 63 arranged opposite each other at the same level as the edge 40 of the die 34. The two tools 62 and 63 perform a simultaneously alternating translatory movement towards each other, along the working plane P, in two successive phases for each cycle, since they are mounted at the ends of respective slides 64 and 65 operated by levers 66 and 67 actuated by the cams 68 and 69 of the front shaft 3 by means of the intermediate lever system 74 shown in FIG. 6. Having two separate operating phases, the two tools 62 and 63 may be each actuated by two separate cams for greater operational control. The ends of the tools 63 and 64 are substantially fork-shaped (as shown in FIGS. 9 and 10) so as to perform their function of guiding and gripping the U-shaped section during their two operational phases.

On the basis of the above, the U-shaped section is conveyed towards the station S2 by the slide 23 and pushed out of the forming element 27 by means of the shoe 42 so as to engage into the eyelets of the last link formed, sliding along the shaped ends of the tools 62 and 63 which in the meantime have moved towards the die 34. While the expulsion shoe 42 remains in contact with the end of the U-shaped section on which it has exerted its expulsive thrust, the pin 47 moves towards the die raising itself so as to arrange itself between the free ends of the U-shaped section (see FIG. 9) in contact with the die 34 along a lateral flat surface thereof (not shown). At the same time the folding tools 55 and 56 converge towards the U-shaped section so as to bring the ends thereof together around the pin 47, while the gripping tools 62 and 63 laterally grip the section, preventing the ends which have just been brought together from moving away again, owing to the elastic effect once the folding tools 55 and 56 have moved away.

In order to rivet the ends of the U-shaped semi-finished product which have just been folded towards each other, there is provided a push rod 73 which is aligned along the working axis X—X on the opposite side of the slide 23 with respect to the die 34. The push rod 73 performs an alternating translatory movement away from and towards the die in two successive phases for each cycle, the first of which being the working phase for riveting. In order to perform these movements, the push rod 73 is fixed to the end of a slide 74 actuated by a lever 75, operated by a pair of cams 76 and 76' of the rear shaft 4 (see FIGS. 4, 6 and 7).

A welding group of known type, the blowpipe of which has been indicated by 71 and the guide for the weld material by 72, is provided in the station S2 in order to weld the ends of the U-shaped section which have just been brought together and riveted and thus form a closed link. The movement of the welding group away from and towards the die 34 is provided by a conventional electromagnetic device, not shown, while the weld material is supplied by means of a roller advancing group operated by a step motor, or equivalent system, of a type well known in the sector.

As shown in FIGS. 5 and 6, along the vertical of the die 34 there is provided a hollow punch 81 mounted slidably at the end of an arm 82 extending horizontally from a vertical upright 84 at the top end of which there is hinged a lever 84 which causes sliding of the punch 81, acting in opposition to elastic return means not shown. The lever 84 is in turn operated in succession by two tappets 85 moved by two cams 86 and 86' of the rear shaft 4. Inside the punch there runs a metal wire 77 which, as the chain is constructed, is accommodated along the internal axis of the chain with the aim of calibrating it internally and helping arrange the links. The wire 77 is drawn along by the links themselves which, folding and settling into position in the passage inside the die 34, adequately grip the said wire.

The push rod 73 concludes its first cycle phase before welding and retracts so as to allow operation of the welding components. Once the latter and the gripping tools 62 and 63, which hitherto had gripped the link, have retracted, the push rod 73 begins its second phase moving again towards the link at the point where it has been welded and acting in opposition to the shoe 42 so as to cause centering of the link on the die 34 with respect to the axis of the punch 81. Once the link has been centered, the punch moves towards the last chain link already formed (see FIG. 11), while the tool 73 moves away and the shoe 42 returns towards the station S1. In its second phase of forward movement, the punch 81 pushes the chain inside the die 34 causing deformation of the last link which folds into a U shape about its middle transverse axis so as to be able to enter into the die. Pushing of the punch 81 ceases when solely the eyelet ends of the link which has just been folded protrude from the die.

With reference to FIG. 12, above the group of the tool 63 there has been placed a pincer group, indicated generally by 100, supported by an upright 101 which rises from the base 2 of the machine. The pincer group 100 comprises a guide block 102 inside which there is slidably mounted a slide 103 carrying at its free end the pincer arms 104*a* and 104*b*. The sliding axis of the slide 103 is coplanar with that of the tool 63 and is inclined towards the die 34, with an angle of inclination equal to about 10°. The pincer arms 104*a* and 104*b* have ends folded downwards in the manner of a beak and each have a conical pin 105 designed to engage into the two eyelets of the lost link formed. The length of the two pincer arms 104*a* and 104*b* is slightly different so as to take into account the inclination of the middle plane in which the link lies with respect to the sliding axis of the slide 103. The movements of the pincer group 100 (sliding of the slide 103 and actuation of the pincer arms 104 *a,b*) is obtained by means of a cam 106, mounted on the rear shaft 4, and associated lever 107. The action of the lever 107 first overcomes the resistance of the return spring 108 so that the pincer 104 *a,b* moves towards the eyelets of the link and then overcomes the resistance of the return springs (not shown) of the wedge 109 which causes closure of the pincer on the eyelets of the link which has just been folded in the die 34.

Once the pincers are closed, the rack 37 causes with its movement an angular displacement of the die 34 about its own axis, twisting the last link folded in a U shape and giving the chain its final appearance, where the links are twisted and all lie on the same plane. Finally, while the pincer 104 *a,b* leaves the link, the die performs an opposite angular displacement of equal amplitude.

It should be noted that, with the arrangement of the rack 37 relative to the die 34 illustrated in FIGS. 4 and 7, a clockwise twist is imparted to the chain, since the shaft 36 rotates in the opposite direction with respect to the axis of the die itself. In the case where it is required to impart to the chain an anti-clockwise twist, it is sufficient to disconnect the rack 37 from the lever 38 and connect it with the corresponding lever, not shown, arranged symmetrically on the opposite side of the bench 2 and actuated by a cam, identical to the cam 39, not shown, provided on the front shaft 3.

It is useful to note, moreover, that the tools which radially surround the die 34, i.e. the folding tools 55 and 56, the gripping tools 62 and 63 and the push rod 73, all operate on the working plane P coinciding with the plane on which the link is formed, in which clearly the edge 40 of the die 34 lies. As can be noted also from the drawings, the abovementioned tools are mounted on identical modular structures. Obviously each of the tools described above, including the push rod 73 and the two counter pins 28 and 47, are shaped so as to be able to match perfectly the surface portion of the U-shaped section or of the link formed with it, with which they are intended to come into contact.

According to a possible variation of the machine according to the invention, the station S1 where the U-shaped section is formed may be replaced with a device for distributing U-shaped sections prepared separately, outside the machine, said distributor being operationally connected to the station S2 by means of the conveying means 1.

Variations and/or modifications may be made to the machine for the production of an ornamental chain of the type with so-called "figure-of-eight" links according to the present invention without thereby departing from protective scope of the invention itself.

We claim:

1. Machine for the production of an ornamental chain of the type with so-called "figure-of-eight" links, said chain consisting of a succession of elongated links having a middle transverse axis folded in a U-shape about their middle transverse axis and twisted about a longitudinal axis of the chain and having a last formed link, comprising:

a working plane (P);

means (S1) for supplying a section of filiform material of predetermined length folded in a U-shape, coplanar with said working plane and in a first working direction (X—X);

a tubular guide (34) of calibrated cross-section, with an axis perpendicular to said working plane, for supporting chain already formed inside of said tubular guide and having an upper edge from which project eyelet ends of the last link formed of said succession of elongated links, said first working direction intersecting the axis of said tubular guide at said ends, said tubular guide being angularly displaceable according to a predetermined amplitude and direction, about said tubular guide axis in order to twist the last formed of said succession of links;

U-shaped section conveying means alternately translating between said supplying means and said tubular guide in said first working direction, for taking up said U-shaped section from said supplying means and engaging arms of said U-shaped section inside the projecting eyelet ends of the last U-shaped link attached projecting from said tubular guide;

means for permanently joining (71, 72) the ends of the arms of said U-shaped section engaged in the last formed link by said elongated links, said means for permanently joining being, movable away from and towards said tubular guide (34) along said working plane (P) and means for centering the resulting closed link with respect to the axis of said guide; and punch means (81) for performing an alternating movement away from and towards the last link attached along the axis of said tubular guide (34) so as to apply a force into said link, causing at the same time sliding of the chain inside said guide and folding of said closed link about its middle transverse axis.

2. Machine according to claim 1, in which said means (S1) for supplying the U-shaped section comprise: a group (6) for supplying said filiform material in a second working direction (Y—Y) lying in said working plane (P) and perpendicular to said first working direction (X—X) means (16) for cutting sections of predetermined length of the filiform material placed downstream from said group (6) along said second working direction (Y—Y), a U-shape section forming element (27) placed downstream from said cutting means substantially where the second working direction (Y—Y) intersects the first working direction (X—X), for folding in a U-shape said section of filiform material; said forming element having a substantially U-shaped cavity (27*a*) portion movable in said first working direction towards said second working direction and a vertically movable abutment element arranged in front of said cavity portion, the cavity portion and the abutment element being placed on an opposing element (42) arranged opposite said forming element on the opposite sides with respect to said second working direction, in which the section of wire is supplied; wherein following the movement of said cavity portion of said forming element, the section of wire is forced against said abutment element and folds into a U-shape inside said cavity.

3. Machine according to claim 2, in which said forming element (27) is mounted on said means for conveying the U-shaped section.

4. Machine according to claim 1, in which said conveying means comprise a first slide (23), capable of sliding in said first working direction (X—X), on which said forming element (27) is mounted, said U-shaped cavity being bounded by a wall on which there is formed a groove for receiving said section while it is being folded, there being provided moreover means (42) for discharging said U-shaped section from said cavity once said tubular guide (34) has been reached.

5. Machine according to claim 4, in which said means for discharging the U-shaped section comprise a thrust element (42) situated on the bottom of said cavity (27*a*) and integral with a second slide (41) carried by said first slide (23) and sliding along it towards said tubular guide (34).

6. Machine according to claim 1, in which said means for permanently joining the ends of the arms of said U-shaped section engaged in the last link of the chain comprise: an opposing element (47) movable with respect to said tubular guide (34) and capable of being positioned in said first working direction between said arms of said U-shaped section; a pair of folding tools (55, 56) and a pair of gripping tools (62, 63) for gripping said U-shaped section arranged symmetrically with respect to said first working direction (X—X) on said working plane, for moving said ends towards each other and to contain laterally the section attached to the last chain link, there being provided moreover a device for welding (71, 72) said ends brought together, movable away from and towards said tubular guide and operating after said folding tools (55, 56) have moved away and while the link is still held by said gripping tools (62, 63).

7. Machine according to claim 1, in which in said first working direction there is provided a push rod (73) for centering the link with respect to the axis of said tubular guide, movable simultaneously away from and towards the latter, acting in cooperation with a thrust element (42) which comes up against the link itself on the opposite side.

8. Machine according to claim 1, in which said tubular guide (34) has a substantially rectangular cross-section having middle axes which are inclined with respect to said first working direction (X—X).

9. Machine according to claim 1, wherein said tubular guide (34) is integral with a hollow shaft (36) mounted on a fixed support (33), and further comprising means (37) for imparting to said hollow shaft (36) an alternating rotary movement of a predetermined angle, and two arms (35) hinged outside said tubular guide said arms being connected elastically so as to keep close together the free ends of the arms which engage laterally inside said tubular guide so as to emerge inside the tubular guide.

10. Machine according to claim 1, comprising moreover pincer means (100) located above a centering means (73) and movable away from and towards said die in order to grip the last link already folded in a U shape before said tubular guide (34) performs said angular displacement.

11. Machine according to claim 10, in which said pincer means (100) comprise a pincer (104), having arms which terminate in ends folded in the manner of a beak with two opposite and staggered conical pins (105) for engaging in the eyelet end of the U-shaped folded link.

12. Machine according to claim 1, in which said punch (81) is hollow, and has a metal wire in said hollow (77) acting as a core for the chain being formed.

13. Machine according to claim 5, in which the gripping tools (62, 63) are substantially fork-shaped, so as to act both as a guide and as a gripper for the U-shaped section.

14. Machine according to claim 1, in which said folding tools (55, 56), said gripping tools (62, 63) have respective opposite ends which said push rod (73) are arranged radially around said tubular guide.

* * * * *